US007946566B2

(12) United States Patent
Schüpbach

(10) Patent No.: US 7,946,566 B2
(45) Date of Patent: May 24, 2011

(54) APPARATUS FOR WIRE-STITCHING PRINT PRODUCTS COMPILED FROM GATHERED SIGNATURES

(75) Inventor: André Schüpbach, Oftringen (CH)

(73) Assignee: Mueller Martini Holding AG, Hergiswil (CH)

( * ) Notice: Subject to any disclaimer, the term of this patent is extended or adjusted under 35 U.S.C. 154(b) by 1270 days.

(21) Appl. No.: 11/121,106

(22) Filed: May 4, 2005

(65) Prior Publication Data

US 2005/0258584 A1 Nov. 24, 2005

(30) Foreign Application Priority Data

May 4, 2004 (EP) ..... 04405279

(51) Int. Cl.
*B65H 37/04* (2006.01)

(52) U.S. Cl. ..... 270/52.17; 270/52.14; 270/52.16; 270/52.18; 270/52.26; 270/52.29

(58) Field of Classification Search ..... 270/52.14, 270/52.16, 52.17, 52.18, 52.19, 52.26, 52.29
See application file for complete search history.

(56) References Cited

U.S. PATENT DOCUMENTS

| | | | | |
|---|---|---|---|---|
| 1,248,252 | A * | 11/1917 | Bredenberg | 412/19 |
| 4,050,686 | A * | 9/1977 | McCain et al. | 270/52.09 |
| 4,118,023 | A * | 10/1978 | Macke | 270/52.17 |
| 5,678,813 | A | 10/1997 | Osako et al. | |
| 6,142,354 | A * | 11/2000 | Boss et al. | 227/100 |
| 6,994,337 | B1 * | 2/2006 | Cracknell et al. | 270/52.29 |
| 7,055,814 | B1 * | 6/2006 | Boss | 270/52.29 |
| 2004/0094883 | A1 * | 5/2004 | Silberbauer | 270/52.18 |

FOREIGN PATENT DOCUMENTS

| | | |
|---|---|---|
| EP | 0 761 472 A1 | 3/1997 |
| EP | 0 917 965 A1 | 5/1999 |
| EP | 1 232 978 A1 | 8/2002 |
| JP | A 05-147628 | 6/1993 |
| JP | A 08-143179 | 6/1996 |
| JP | A 09-066685 | 3/1997 |
| JP | A 09-109572 | 4/1997 |
| JP | A 2000-006547 | 1/2000 |
| JP | A 2001-162968 | 6/2001 |
| JP | A 2002-302320 | 10/2002 |

OTHER PUBLICATIONS

Notification of Reasons for Rejection issued in related Japanese Patent Application No. 2005-135397 on Jul. 23, 2010.

* cited by examiner

*Primary Examiner* — Leslie A Nicholson, III
(74) *Attorney, Agent, or Firm* — Venable LLP; Robert Kinberg; Steven J. Schwarz

(57) ABSTRACT

An apparatus for wire-stitching print products compiled from gathered signatures and for trimming open edges of the print products, includes a first gathering and wire-stitching machine including a first wire-stitching unit. A first cutter is installed downstream from the first gathering and wire-stitching machine. A second gathering and wire-stitching machine having a second wire-stitching unit is selectively connected in-line with the first gathering and wire-stitching machine. A second cutter is installed downstream from the second gathering and wire-stitching machine. A transfer element is also positioned between the first and second gathering and wire-stitching machines for transferring print products or partial print products from the first gathering and wire-stitching machine to the second gathering and wire-stitching machine. The apparatus further includes a drive motor operatively arranged with the first gathering and wire-stitching machine and the first cutter. The first cutter may be selectively coupled and uncoupled with the drive motor.

13 Claims, 3 Drawing Sheets

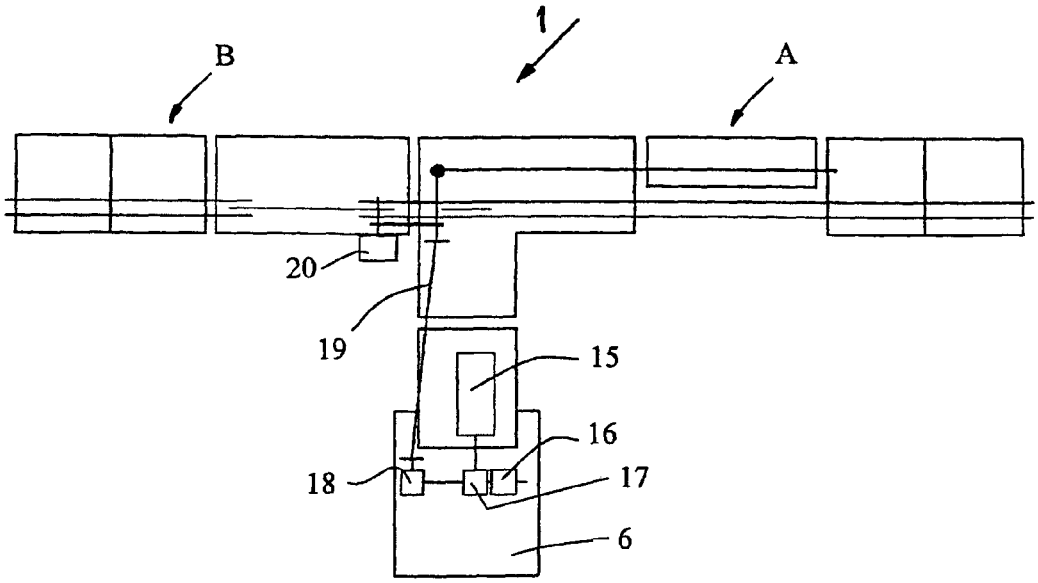
Fig. 1
Fig. 2a
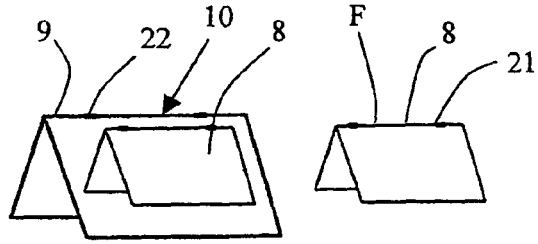
Fig. 2b
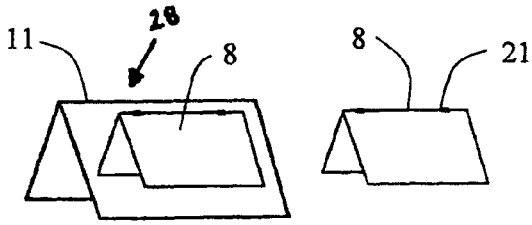
Fig. 2c
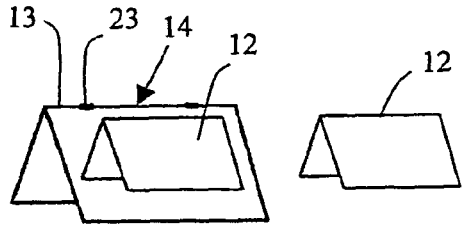

APPARATUS FOR WIRE-STITCHING PRINT PRODUCTS COMPILED FROM GATHERED SIGNATURES

CROSS-REFERENCE TO RELATED APPLICATION

This application claims the priority of European Patent Application No. 04405279.3-2304, filed on May 4, 2004, the subject matter of which is incorporated herein by reference. The disclosure of all U.S. and foreign patents and patent applications mentioned below are also incorporated herein by reference.

BACKGROUND OF THE INVENTION

The invention relates to an apparatus for wire-stitching print products, compiled from gathered signatures, and for trimming the print products along the open side edges. The apparatus includes a first gathering and wire-stitching machine provided with a first wire-stitching unit and a first cutter which is installed downstream from the first gathering and wire-stitching machine. A second gathering and wire-stitching machine can be added in-line with the first gathering and wire-stitching machine and is provided with a second wire-stitching unit. The apparatus also includes a second cutter installed downstream from the second gathering and wire-stitching machine. The apparatus furthermore includes a transfer element positioned between the first and second gathering and wire-stitching machines.

A tandem arrangement of gathering and wire-stitching machines of the aforementioned type is disclosed in European Patent Document EP 1 232 978 A1, wherein the first gathering and wire-stitching machine is also called a slave and the second gathering and wire-stitching machine is also called a master. Both gathering and wire-stitching machines are respectively provided with a gathering chain or other suitable conveying device, at least one feeder, one wire-stitching unit, a cutting device, an ejection device and a cross stacker. The resulting print products are stacked in the cross stacker. The cutters may be three-knife trimmers and are also called trimmers. The ejection device for transferring the print products to the first cutter is arranged downstream from the first wire-stitching unit. This tandem arrangement of gathering and wire-stitching machines can optionally be used for a so-called solo operation or a tandem operation.

For the solo operation, the two gathering and wire-stitching machines work separately and the transfer element is therefore not in use. The ejection device for the first gathering and wire-stitching machine is turned on. Each cutter is provided with an asynchronous motor and each wire-stitching unit is provided with a servomotor, wherein the servomotor respectively follows the asynchronous motor and operates the gathering chain as well as the feeders for the separate gathering and wire-stitching machine.

For the tandem operation, the two gathering and wire-stitching machines are connected to each other via the transfer element. They operate synchronously, but the asynchronous motor for the first cutter and the ejection device for the first cutter are shut down. During the tandem operation, the first cutter cannot be operational because the knives would otherwise become dull. The servomotor for the first wire-stitching unit follows the asynchronous motor of the second cutter. This arrangement has the disadvantage that it is not possible to pre-stitch products with the first wire-stitching unit. For the tandem operation, the print products pass through the first wire-stitching unit while this unit is shut down and are thus not stitched. If a pre-stitching of the products is desired, they must be stitched in an additional gathering and wire-stitching machine and must be fed in a second time.

SUMMARY OF THE INVENTION

It is an object of the present invention to create an apparatus of the aforementioned type where first and second gathering and wire-stitching machines connected in-line permit a pre-stitching of a partial product in the first gathering and wire-stitching machine.

The above and other objects are achieved by the instant invention which provides an apparatus for wire-stitching print products compiled from gathered signatures and for trimming open edges of the print products, said apparatus comprising a first gathering and wire-stitching machine including a first wire-stitching unit; a first cutter installed downstream from the first gathering and wire-stitching machine; a second gathering and wire-stitching machine selectively connected in-line with the first gathering and wire-stitching machine and including a second wire-stitching unit; a second cutter installed downstream from the second gathering and wire-stitching machine; a transfer element positioned between the first and second gathering and wire-stitching machines for transferring print products or partial print products from the first gathering and wire-stitching machine to the second gathering and wire-stitching machine; and a drive motor operatively arranged with the first gathering and wire-stitching machine and the first cutter, the first cutter adapted to be selectively coupled and uncoupled with the drive motor.

With the apparatus according to the invention, the first cutter may be disconnected from the main drive during the tandem operation and is thus inoperative. The first wire-stitching unit is operated by a drive motor operatively associated with the first gathering and wire-stitching machine and the first cutter. The first wire-stitching unit is not operated by the asynchronous motor for the second cutter, as was the case in the prior art. As a result, it is possible to gather straddling signatures conveyed on the first gathering and wire-stitching machine and stitch these in a first wire-stitching unit. The pre-stitched partial products can then be transported by the transfer element to feeders for the second gathering and wire-stitching machine which deposit additional sheets on the pre-stitched print product. The wire-stitching unit for the second gathering and wire-stitching machine then stitches together the complete product, meaning the individual sheets from the second gathering and wire-stitching machine and the pre-stitched signatures from the first gathering and wire-stitching machine.

Also possible is a tandem operation in which only the partial products from the first gathering and wire-stitching machine are stitched. The additional sheets added in the second gathering and wire-stitching machine are then simply placed on top of the pre-stitched partial products and are not stitched.

According to a further exemplary embodiment of the invention, the aforementioned drive motor is arranged on the first cutter. For the solo operation, this drive motor is connected via a coupling to the first cutter. Alternatively, for the tandem operation, the first cutter is uncoupled from the drive motor. The drive motor operates the first wire-stitching unit, for example via a gear arrangement, as well as the feeders for the first gathering and wire-stitching machine and the first gathering chain. The transfer element is also driven by the motor for the first gathering and wire-stitching machine, for example, by a superimposed gear.

According to another exemplary embodiment of the invention, the drive motor is arranged on the first wire-stitching unit and may also be connected to the first cutter. During the solo operation, the drive motor of the first wire-stitching unit drives the first cutter, for example, by an additional gear arrangement. The drive motor also drives the feeders and a gathering chain for the first gathering and wire-stitching machine.

According to yet another exemplary embodiment of the invention, the aforementioned drive motor is a servomotor and, in particular, is connected via a gear arrangement to other elements of the first gathering and wire-stitching machine. The elements operated by the drive motor include in particular the gathering chain and the feeders for the first gathering and wire-stitching machine.

According to a further exemplary embodiment of the invention, a pre-stitching operation is provided for wherein the first cutter is decoupled from the aforementioned main drive motor and the aforementioned main drive motor operates the first wire-stitching unit, as well as a gathering chain and feeders for the first gathering and wire-stitching machine. An ejection device installed downstream from the first gathering and wire-stitching machine is uncoupled. The pre-stitched partial products can be supplemented in the second gathering and wire-stitching machine with additional sheets to form a complete product. The second wire-stitching unit in this case can stitch the complete product, meaning the individual sheets from the second gathering and wire-stitching machine, as well as the pre-stitched signatures from the first gathering and wire-stitching machine.

Further advantageous features will become apparent from the following description, drawings and examples.

BRIEF DESCRIPTION OF THE DRAWINGS

An exemplary embodiment of the invention is explained in further detail with the aid of the accompanying drawings.

FIG. 1 depicts a schematic view from the top of an apparatus according to the invention, wherein the second gathering and wire-stitching machine is shown only partially;

FIGS. 2*a*-2*c* schematically depicts three options for producing a complete product;

DETAILED DESCRIPTION OF THE INVENTION

Figure 3:
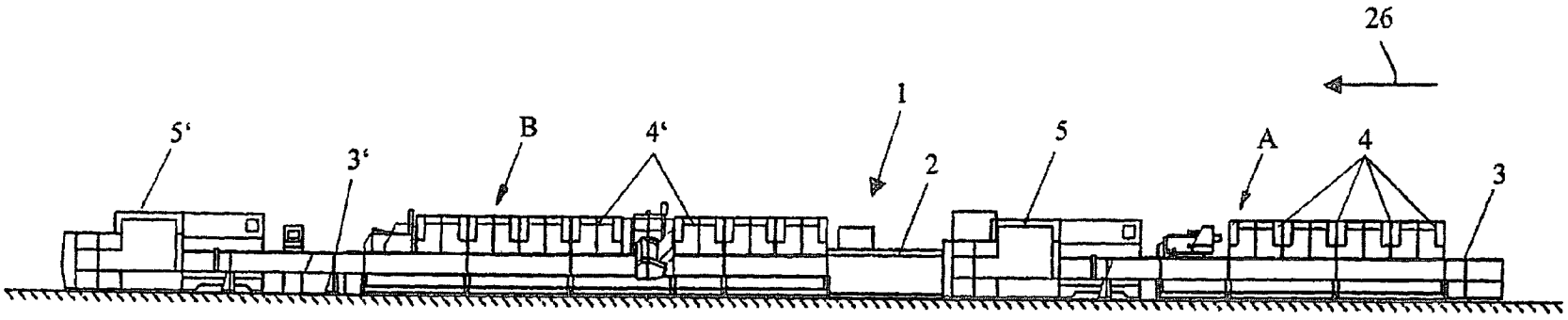
FIG. 3 schematically depicts a view from the side of the apparatus according to the invention.
Figure 4:
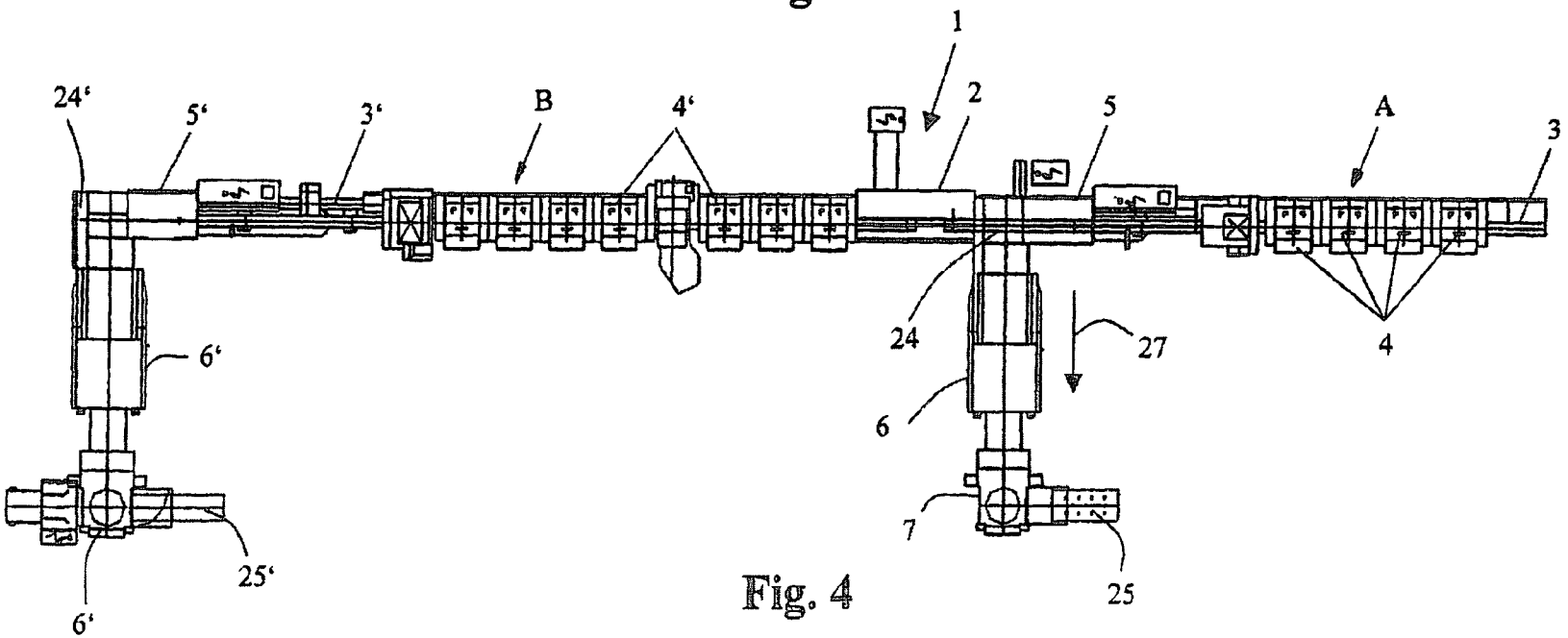
FIG. 4 depicts a view from above of the apparatus shown in FIG. 3.

FIGS. 1, 3 and 4 show an apparatus 1 including a first gathering and wire-stitching machine A and a second gathering and wire-stitching machine B arranged in line relative to each other. A transfer element 2 can be used to connect the two gathering and wire-stitching machines A and B for the conveying operation. Products and/or partial products can be transferred from the first gathering and wire-stitching machine A to the second gathering and wire-stitching machine B with the aid of this transfer element 2. A transfer element 2 of this type is described, for example, in European Patent Document EP 1 232 978 A1.

The first gathering and wire-stitching machine A comprises a gathering chain 3, for example, or a different conveying device suitable to convey signatures that are positioned straddling the gathering chain 3. An arrow 26 in FIG. 3 indicates the conveying direction from right to left. The first gathering and wire-stitching machine A is additionally provided with several feeders 4 which serve to respectively deposit printed sheets or signatures onto the gathering chain 3. A wire-stitching unit 5 for stitching the gathered signatures along their fold F is arranged downstream from the feeders 4. An ejection device 24, which is known per se, follows the wire-stitching unit 5 and is used to lift the gathered signatures off the gathering chain 3 to supply them to a first cutter 6. The arrow 27 in FIG. 4 indicates the transporting direction following the ejection device 24, wherein the direction of transport inside the cutter 6 is at a right angle to the transporting direction according to arrow 26. In one exemplary embodiment, the first cutter 6 is a three-knife cutter. The cutter 6 may be followed by a cross stacker 7 for stacking the trimmed printed products. Finally, a conveyor belt 25 may also be provided for delivering the stacks.

The second gathering and wire-stitching machine B can have the same or a similar design as the first gathering and wire-stitching machine A. In that case, several feeders 4' are arranged after the transfer element 2 and serve to deposit signatures on a gathering chain 3'. A wire-stitching unit 5' is arranged in front of an ejection device 24', wherein this unit can be identical to the wire-stitching unit 5. Finally, the second gathering and wire-stitching machine B may be provided with a cutter 6', a cross-stacker 7', as well as a conveyor belt 25'.

The apparatus 1 can basically be operated in two modes. For the first operating mode, the so-called solo operation, the two gathering and wire-stitching machines A and B are used separately and the transfer element 2 is shut down. Both gathering and wire-stitching machines A and B can be operated simultaneously. Also possible is the use of only one or the other of the gathering and wire-stitching machines A and B. The second mode of operation is a so-called tandem operation for which the two gathering and wire-stitching machines A and B are connected by the transfer element 2. The cutter 6 and correspondingly also the cross-stacker 7 and the conveyor belt 25 are shut down. The tandem operation, in turn, operates in three different modes which are explained in further detail in the following, using the FIGS. 2*a* to 2*c*.

A first partial product 8 is produced in the first gathering and wire-stitching machine A when using the first mode of tandem operation according to FIG. 2*a*. This first partial product can consist of several signatures which are not shown in further detail herein. The first partial product 8 has a fold F and is transported by the gathering chain 3 in a straddling position, as indicated in FIG. 1. The first partial product 8 is wire-stitched in the first wire-stitching unit 5 and is provided along the fold F with two wire staples 21. The first partial product 8 is transferred to the second gathering and wire-stitching machine B by the transfer element 2 where a second partial product 9 is produced on the basis of the first partial product 8. This second partial product 9 is again wire-stitched with staples 22, which can also grip the partial product 8. A complete product 10 is thus created from the two partial products 8 and 9. The complete product 10 contains a separately stitched partial product 8 on the inside. The complete product 10 is then supplied to the second cutter 6' and is trimmed along the top, bottom and side in the standard way. Finally, the complete products 10 are stacked inside the cross stacker 7' and delivered by the conveyor belt 25'.

According to the second mode of tandem operation as shown in to FIG. 2*b*, only the first partial product 8 is wire-stitched. A second partial product 11 is produced in the second gathering and wire-stitching machine B and is then added to the first partial product 8. However, the second partial product 11 is not stitched. The complete product 28 therefore consists of a wire-stitched first partial product 8 and a second partial product 11, for example, a simple sheet or a cover or the like.

With the third mode of tandem operation according to FIG. 2*c*, a non-stitched first partial product 12 is produced in the first gathering and wire-stitching machine A, wherein the first wire-stitching unit 5 does not stitch in this case. In the second gathering and wire-stitching machine B, a second partial product 13 is placed on the first partial product 12 and is stitched with wire staples 23, wherein the wire staples 23 can simultaneously grip the non-stitched first partial product 12. The complete product 14 is trimmed in the second cutter 6'.

According to the exemplary embodiment of FIG. 1, a drive motor 15, for example a servomotor, is arranged on the first cutter 6. The drive motor 15 is provided with a gear 17 which can be coupled by a coupling 16 to the cutter 6. This coupling 16 may be an electromagnetic coupling which can be actuated with the aid of a control device.

The drive motor 15 will operate the cutter 6 in the coupled state, whereas the cutter 6 is shut down in the uncoupled state. That is the case for the tandem operation since the knives on the cutter 6 should not be operational or they will become dull.

The gear 17 may be connected via another gear 18 to a gear arrangement 19 to which the drive motor 15 and the additional operating elements of the first gathering and wire-stitching machine A are connected as well. These include, in particular, the first wire-stitching unit 5, the feeders 4, as well as the gathering chain 3. A superimposed gear 20, or a different suitable gear, of the first gathering and wire-stitching machine A can simultaneously drive the transfer element 2. If the first cutter 6 is uncoupled, the drive motor 15 becomes the main drive for the first wire-stitching unit 5, the feeders 4, and the gathering chain 3. When using this operating mode, the first partial product 8 shown in FIGS. 2*a* and 2*b* can be stitched with the first wire-stitching unit 5. The first partial products 8 are thus pre-stitched and then transferred with the transfer element 2 to the second gathering and wire-stitching machine B.

Figure 5:
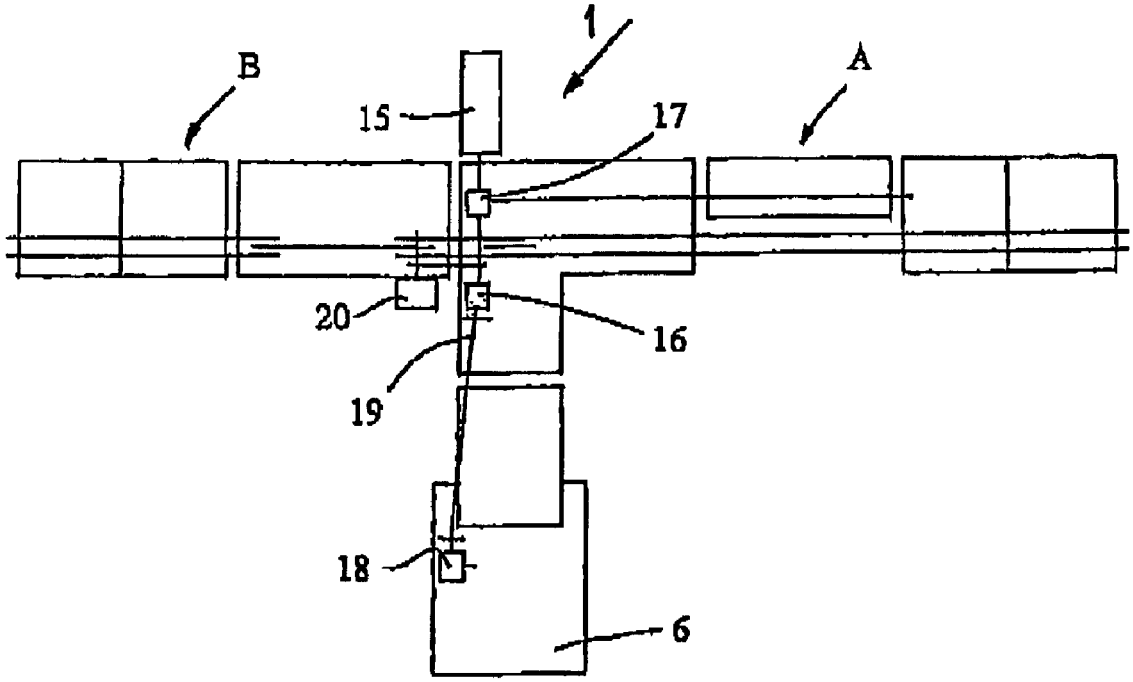
FIG. 5 depicts another schematic view from the top of an apparatus according to the invention, wherein the second gathering and wire-stitching machine is shown only partially.

According to another embodiment illustrated in FIG. 5, the drive motor 15 may be arranged on the first wire-stitching unit 5 while the other features remain the same. In this embodiment, the drive motor 15 is connected via a coupling 16 to the cutter 6.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for wire-stitching print products compiled from gathered signatures and for trimming open edges of the print products, said apparatus comprising;

a first gathering and wire-stitching machine including a first wire-stitching unit;

a first cutter installed downstream from the first gathering and wire-stitching machine;

a second gathering and wire-stitching machine selectively connected in-line with the first gathering and wire-stitching machine and including a second wire-stitching unit, for operation in tandem with the first gathering and wire-stitching machine;

a second cutter installed downstream from the second gathering and wire-stitching machine;

a transfer element positioned between the first and second gathering and wire-stitching machines for transferring print products or partial print products from the first gathering and wire-stitching machine to the second gathering and wire-stitching machine during the tandem operation; and a drive motor operatively coupled to the first gathering and wire-stitching machine and the first cutter in a solo operation of the first gathering and wire-stitching machine, the first cutter being uncoupled from the drive motor during the tandem operation, wherein the first wire-stitching unit is operated by the drive motor independently from the second gathering and wire-stitching machine during the tandem operation.

2. The apparatus according to claim 1, wherein the drive motor is coupled to the first wire-stitching unit of the first gathering and wire-stitching machine.

3. The apparatus according to claim 1, wherein the drive motor is arranged on the first cutter.

4. The apparatus according to claim 1, wherein a disengageable coupling optionally couples the drive motor to the first cutter.

5. The apparatus according to claim 1, wherein the drive motor is arranged on the first wire-stitching machine.

6. The apparatus according to claim 1, further including a gear arrangement drive-connecting the drive motor to the first gathering and wire-stitching machine.

7. The apparatus according to claim 1, wherein the first gathering and wire-stitching machine comprises an ejection device installed downstream from, and selectively coupled and uncoupled with, the first wire-stitching unit, wherein the ejection device is uncoupled from the first gathering and wire-stitching machine during the tandem operation of the first and second gathering and wire-stitching machines.

8. The apparatus according to claim 1, wherein the first gathering and wire-stitching machine is arranged to gather and wire-stitch a first partial product to be positioned on the inside of a complete print product during the tandem operation.

9. The apparatus according to claim 1, and further including separate, synchronously operating first and second conveying devices operatively associated with the first and second gathering and wire-stitching machines, respectively, for transporting the print products.

10. The apparatus according to claim 1, wherein the drive motor includes a servomotor.

11. An apparatus for operating two machines in one of a solo or a tandem mode, comprising:

a first machine including:

a first wire-stitching unit to wire-stitch a first print product in the solo and tandem modes, a first cutter installed downstream from the first wire-stitching unit to trim the first print product in the solo mode, and a drive selectively coupled to the first cutter, the drive being disengaged from the first cutter in the tandem mode and being engaged with the first cutter in the solo mode, and coupled to the first wire-stitching unit to drive the wire-stitching of the first print product in the solo and tandem modes;

a second machine operationally connected with the first machine in the tandem mode to insert the wire-stitched first print product into a second print product to produce a complete print product, including:

a second wire-stitching unit to selectively wire-stitch a second print product and the wire-stitched first print product, and a second cutter installed downstream from the second wire-stitching unit to trim the complete print product; and a stacker to stack the complete print products.

12. The apparatus according to claim 11, wherein the drive motor includes a servomotor.

13. The apparatus according to claim 11, wherein the drive is controlled independently from the operation of the second machine.

* * * * *